United States Patent [19]

Schäfer

[11] 4,215,826

[45] Aug. 5, 1980

[54] MECHANISM FOR MOUNTING THE SHELL OF THE BREAKER IN CONE CRUSHERS

[75] Inventor: Arnold Schäfer, Neustadt, Fed. Rep. of Germany

[73] Assignee: IBAG-Vertrieb GmbH, Neustadt, Fed. Rep. of Germany

[21] Appl. No.: 14,039

[22] Filed: Feb. 22, 1979

[30] Foreign Application Priority Data

Mar. 10, 1978 [DE] Fed. Rep. of Germany ..... 2810419

[51] Int. Cl.[2] ..... B02C 2/04

[52] U.S. Cl. ..... 241/207; 241/285 R

[58] Field of Search ..... 241/207-216, 241/285 R, 299

[56] References Cited

U.S. PATENT DOCUMENTS 3,533,569 10/1970 Carter, Jr. ..... 241/299

4,010,905 3/1977 Motz et al. ..... 241/207 X

*Primary Examiner*—Mark Rosenbaum

*Attorney, Agent, or Firm*—Orville N. Greene; Frank L. Durr

[57] ABSTRACT

The shell of the breakers is mounted on the upper part of the housing of a cone crusher in such a way that when expansion of the shell occurs under operation of the cone crusher the mounting bolts are not twisted or sheared and at the same time are readily accessible for replacement. Thus the shell is provided with a number of symmetrically spaced pockets around the middle part of its outer surface, each of these pockets extends through a corresponding opening in the casing and is connected to a mounting bolt for attaching to the casing through the intermediary of a two-arm lever directed radially away from the shell.

5 Claims, 2 Drawing Figures

MECHANISM FOR MOUNTING THE SHELL OF THE BREAKER IN CONE CRUSHERS

The mounting of the shells of cone crushers is laden with a series of problems, which have their origin above all in the size alteration of the shell of the breaker with long operation. The shell, which as a general rule consists of hard manganese steel, in the course of its useful life undergoes in the breaker not only direct abrasion phenomena but it subject to strain under the action of the crushing cone which is made noticable essentially in lower zones of the shell.

In order to be able to allow for the size alterations in the course of operation, the holding screws or holding bolts as a general rule cooperate with certain elastic parts so that an excess strain and thereby a breaking of the holding screws on account of the size-changes of the shell of the breaker is avoided as much as possible.

With one known embodiment of the applicants assignees, there is introduced between the holding nut and the support in the upper part of the housing an intermediate body of elastic material. With another known manufacturer, screw pressure springs are provided instead of a solid elastic body. With these embodiments, it must, however, be taken into account that in the course of operation through the form changes of the breaker shell, the screw bolts after a certain time are so extensively twisted and accordingly directly shear stressed at the attachment of the screw head that it will fail.

It happens in addition that these screw bolts in the upper part of the housing of the crusher are arranged in a zone below the charging cone. In order to make them accessible this charging cone must also be dismounted. Besides they are exposed to excessive dirt, what, with the screw-compression spring, gives rise to the probability that they are more quickly obstructed with dirt, so that they no longer are in a position to elastically absorb forces transmitted through the structural changes of the breaker shell.

Other known embodiments do not place the mounting screws in the range of the upper part of the housing so that they are easier to reach. They engage then, however, wholly at the top of the breaker shell which therefore is unfavorable because the size change in the breaker shell occurs directly in its lowermost zone where the gap opposite the breaker cone is narrow. Besides not any elastic intermediate parts are provided there.

This invention is based on the problem of building a mechanism for holding the breaker shell in cone crushers so that the connection between the breaker shell and the mounting screws is established about in the middle zone of the breaker shell, that the holding bolts are nevertheless accessible, are also not positioned in the area immediately below the charging cone, and finally no longer have the problem of unsatisfactory fulfillment of the known elastic intermediate parts, especially screw compression springs.

The invention solves this problem through a mechanism for mounting the breaker shells in the cone crusher in a manner such that the breaker shell is equipped with pockets opening to the outside at symmetrical intervals distributed around its circumference, in each of which pockets a double arm lever engages which in turn is supported in the upper part of the housing and wherein the free end of each lever is fastened by suitable holding bolts in the upper part of the housing.

Advantageously the lever arm proportion between that arm at the breaker shell and that arm at the casing is approximately 1:2.

Furthermore the lever can be equipped with dogs one of which fits into a corresponding concave bay on the inner surface of the pocket provided in the breaker shell and the other of the dogs being supported on a counter dog on the housing. Thereby the lever is unshiftably fixed in its longitudinal direction.

For the mounting bolt, orifices in the outer side of the levers may be provided with countersinks in which a cone shaped washer surrounding the mounting bolt is arranged below the screw-nut for the bolt.

The fixing of the mounting bolt to the upper part of the housing results advantageously in a pocket formed in the upper part of the housing which pocket has a suitable slit for admitting the bolt.

The invention is further explained in the following description which, when considered in connection with the accompanying drawing, illustrates by way of example and schematically an embodiment of the mechanism of the invention.

Figure 1:
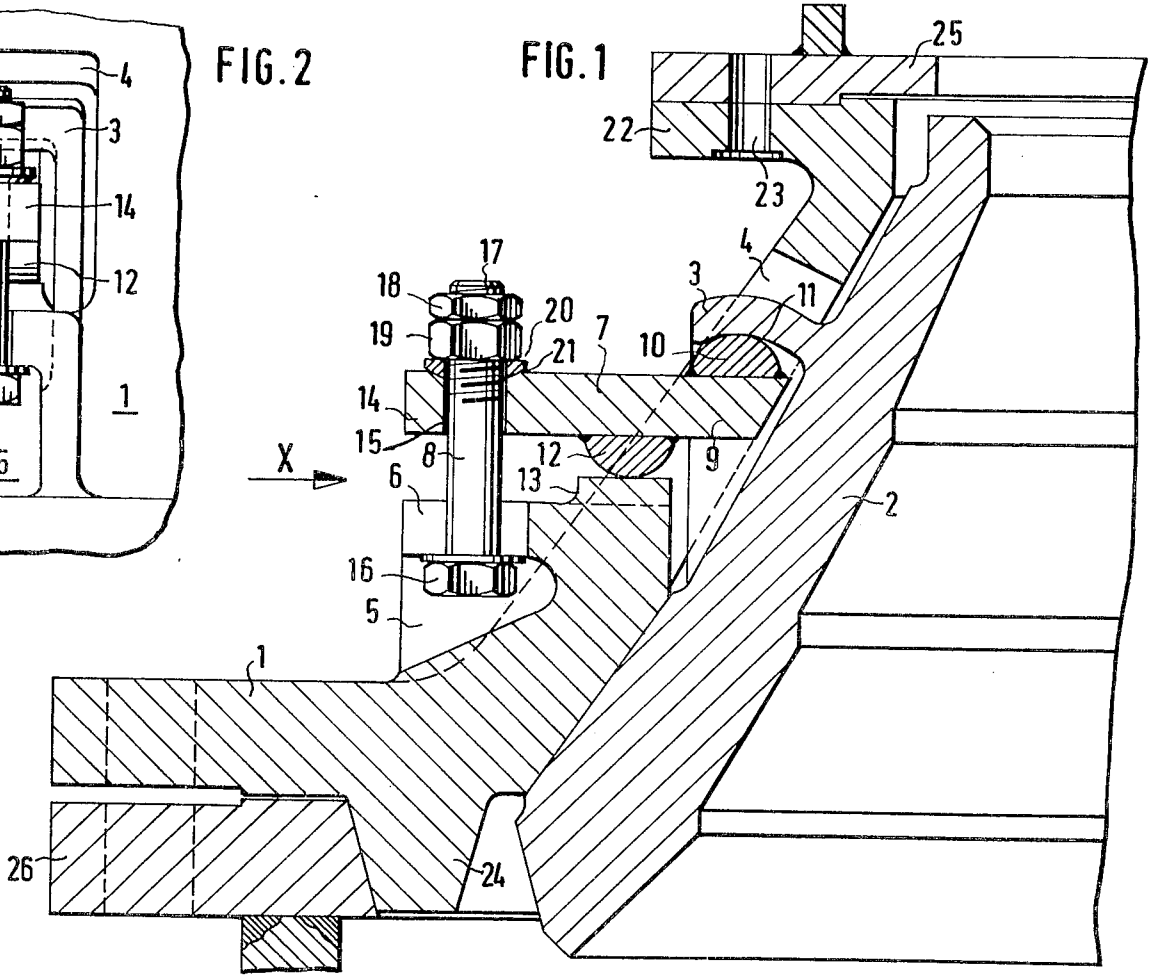
FIG. 1 shows a partial cross section through a cone crusher in the zone of the shell of the breaker and of the cooperating upper part thereof.
Figure 2:
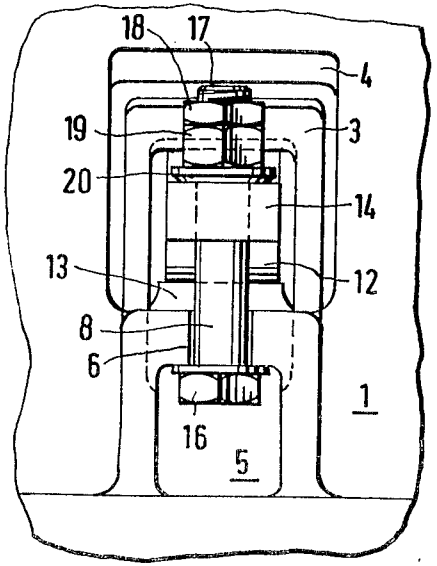
FIG. 2 is a side view taken in the direction of arrow X of FIG. 1.

In the upper part of housing 1, of a cone crusher, the breaker shell 2 is arranged. The upper part of housing 1 consists as usual of normal steel material, the shell 2 is of hard manganese steel. Under the influence of the crusher materials, the breaker shell is exposed to a continuous expansion stress which leads to a dimensional change, which must be taken up by the holding means (which as a general rule are mounted by bolts) in some way in order to prevent a break in these holding means.

According to the invention the breaker shell 2 is equipped at symmetrical intervals around its outer surface with pockets 3. There can, for example, be six or eight of said pockets provided. The form of these pockets can best be compared with a kind of canopy or roof cowl.

Appropriate to these pockets, orifices 4 are provided in the housing 1, through which the pockets 3 project to the outside. Pockets 5 in the housing 1 associated with the orifices 4 have in their upper area a radially directed slit 6. As actual holding means, a double arm lever 7 and a holding screw-bolt 8 are provided. The double arm lever 7 has one arm 9 projecting into the pocket 3 of the shell 2 and lies close, through the attached pressure dog 10, to the upper inner surface 11 of the pocket 3. The double arm lever 7 is supported in the orifice 4 of housing 1 from a pressure dog 12 (or fulcrum) on a counter support 13. This counter support 13 is provided with a dressed surface. The pressure dogs 12 can be made in a simple way, e.g., from semi-cylindrical steel rods.

The other lever arm 14 of double lever 7 has an opening 15 for the attaching bolt 8. The latter is installed in the slit 6 of the pocket 5 of the housing, its head 16 lies closely on the underside of the slit and is fastened at its free end by means of two nuts 18 and 19, of which the nut 18 serves as a locking or safety nut. Between the nut 19 and the upper surface of the lever 7, a conical nut 20 is inserted which engages with a countersink 21 of about 120° in the upper area of the opening 15.

The lever arm proportion of the two arms 9 and 14 of lever 7 amounts to about 1:2.

Through the structure of the invention, it is firstly made sure that the holding bolt 8 can never be tilted so far that its load will be so great that it tears away or shears off. Before that happens the lever 7 will be deformed. Through the interpositioning of the lever 7, the bolt 8 can extend so far to the outside that it lies beyond the range under the charging funnel 25 and so is easily accessible and is not so extensively exposed to dirt as the screw bolts which are positioned under the charging funnel in the known arrangements.

The charging funnel 25 is positioned on the holding flange 22 of the upper part of shell 1, in which clamping orifices 23 are visible. The upper part of the housing 1 is mounted with the nose 24 interlocked in the lower part of the housing 26.

I claim:

1. A mechanism for holding the shell of the breaker in a cone crusher of the type having a housing with a vertical axis and a breaker shell within the housing, the improvement comprising, said breaker shell having distributed symmetrically over its intermediate zone of its outer surface a plurality of pockets each comprising a projecting canopy-like portion, said housing including an upper part containing openings through which said pockets on the breaker shell are adapted to project, a plurality of double arm levers corresponding to the number of said pockets, each of said double arm levers having a fulcrum, a first arm extending radially inwardly from the fulcrum and into a pocket from below and a second arm extending radially away from the fulcrum and said shell, counter support means on the housing to support said fulcrum, the second arm of each said lever being connected to the said upper part of the housing by a bolt.

2. The mechanism as claimed in claim 1 wherein the lever proportion between the first arm and the arm connected to the upper part of the housing is approximately 1:2.

3. The mechanism as claimed in claim 1 or 2 wherein said lever is equipped with dogs, one of which extends into the pocket of said breaker shell, and the other of which is supported on said counter supporting means.

4. The mechanism as claimed in claim 1 wherein at least one of said levers comprises a hole adjacent the end of its second arm to accommodate the bolt which connects it to said upper part of the housing, said hole being countersunk at its upper end, a cone shaped washer for said bolt fitting into said countersink and at least one attaching nut over the washer.

5. The mechanism as claimed in claim 1 wherein said upper part of the housing is provided with a plurality of pockets corresponding to the number of levers and bolts, each of said latter pockets having a slit therein adapted to hold the head of the connecting bolt.

* * * * *